US008967278B2

(12) United States Patent
Sugden

(10) Patent No.: US 8,967,278 B2
(45) Date of Patent: Mar. 3, 2015

(54) COLLAR ASSEMBLY FOR BREAKING TUBING HANGER CONNECTIONS

(75) Inventor: Daryl Richard Sugden, Innisfail (CA)

(73) Assignee: Nabors Canada, Calgary, Alberta (CA)

( * ) Notice: Subject to any disclaimer, the term of this patent is extended or adjusted under 35 U.S.C. 154(b) by 535 days.

(21) Appl. No.: 13/353,356

(22) Filed: Jan. 19, 2012

(65) Prior Publication Data

US 2012/0181047 A1 Jul. 19, 2012

Related U.S. Application Data

(60) Provisional application No. 61/434,115, filed on Jan. 19, 2011.

(51) Int. Cl.
*E21B 19/16* (2006.01)
*E21B 33/04* (2006.01)

(52) U.S. Cl.
CPC ..... *E21B 19/163* (2013.01); *E21B 33/04* (2013.01)
USPC ..... 166/380; 166/77.53; 166/77.51; 166/85.1

(58) Field of Classification Search
CPC ..... E21B 19/16; E21B 19/07; E21B 19/10; E21B 43/106
USPC ..... 166/380, 77.53, 77.51, 85.1
See application file for complete search history.

(56) References Cited

U.S. PATENT DOCUMENTS 3,799,009 A 3/1974 Guier
4,989,909 A * 2/1991 Bouligny et al. ..... 294/119.3
5,060,542 A 10/1991 Hauk
5,276,365 A 1/1994 Maekawa
6,505,531 B2 1/2003 Stogner
6,829,968 B2 12/2004 Hauk et al.
7,055,594 B1 6/2006 Springett et al.
7,231,984 B2 6/2007 Jaensch
7,313,986 B2 1/2008 West et al.
7,360,603 B2 4/2008 Springett et al.
7,665,530 B2 2/2010 Wells et al.
7,681,649 B2 3/2010 Cerovsek
7,707,913 B2 5/2010 Halse
2003/0234101 A1* 12/2003 Ayling ..... 166/77.53
2007/0068669 A1 3/2007 Lesko
2009/0272235 A1 11/2009 Berry
2009/0277308 A1* 11/2009 Light et al. ..... 81/57.16
2010/0101805 A1 4/2010 Angelle et al.
2010/0230166 A1 9/2010 Sigmar et al.
2010/0288509 A1 11/2010 Southard
2010/0307826 A1 12/2010 Connell
2011/0000682 A1 1/2011 Webre et al.
2011/0030512 A1 2/2011 Begnaud, Jr.

* cited by examiner

*Primary Examiner* — Nicole Coy
(74) *Attorney, Agent, or Firm* — Haynes and Boone, LLP

(57) ABSTRACT

An apparatus includes a first housing portion comprising a first adjustable gripping system moveable between an engaged position that grips a cylindrical outer surface of a first tubular structure having a first diameter and a disengaged position that permits relative movement of the first housing portion and the first tubular structure. The apparatus also includes a second housing portion fixed relative to the first housing portion so that rotation of the first housing portion results in rotation of the second housing portion. The second housing portion includes a second gripping system to securely grip a cylindrical outer surface of a second tubular structure that is threadably attached to the first tubular structure and has a second diameter different than the first diameter. Methods of breaking tubing hanger connections are also disclosed.

23 Claims, 5 Drawing Sheets

COLLAR ASSEMBLY FOR BREAKING TUBING HANGER CONNECTIONS

CROSS-REFERENCE TO RELATED APPLICATIONS

This application claims the benefit of and priority to U.S. Provisional Application No. 61/434,115, filed Jan. 19, 2011, entitled "Tubing Hanger Breaker," the entire disclosure of which is hereby incorporated herein by reference.

BACKGROUND OF THE DISCLOSURE

Tubing hangers, also known as dognuts, are often used to connect tubing or pipe in a string to a pup joint. A typical tubing hanger has a threaded inner diameter at one end that receives and threads onto an end of the pup joint of the string. A threaded inner diameter at its opposite end receives and threads to the tubing of the string. Tubing hangers come in various sizes and with various external cylindrical shapes.

From time to time, for clean-up, repair, or for other reasons, the tubing hangers must be removed from their strings. One removal method includes transferring power-tong breaking torque from the pup joint to the bottom connection of the tubing hanger so that the tubing hanger unthreads from the tubing.

A removal tool may be used to prevent unthreading of the wrong connection. A conventional removal tool that engages both the pup joint and the bottom connection of the tubing hanger is formed of two pipe wrenches connected by a chain extending between wrench handles. One pipe wrench connects to the pup joint and the other connects to the tubing hanger. With the pipe wrenches engaged, power tongs may apply torque through the pup joint, which is transferred through the chain to the tubing hanger, preventing relative rotation between the pup joint and the tubing hanger. Accordingly, the pup joint and tubing hanger together rotate relative to the tubing or pipe string to unthread the tubing hanger from the tubing or pipe string. Such a removal tool can, however, be cumbersome, hard to adjust, difficult to hold in place until the power tongs apply sufficient loading to hold the tool in place and may impose some risk to the users by slipping or breaking. Because tubing hangers have external profiles that vary in shape, easy to use removal tools that are generic to these multiple shapes, that may be easier to use, and/or that decrease risks would be helpful.

The apparatuses and methods described herein may overcome one or more of the deficiencies in conventional systems.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 4-1 is an illustration of an exemplary jaw assembly in a disengaged position according to one or more aspects of the present disclosure.

FIG. 4-2 is an illustration of an exemplary jaw assembly in an engaged position according to one or more aspects of the present disclosure.

DETAILED DESCRIPTION

Figure 1:
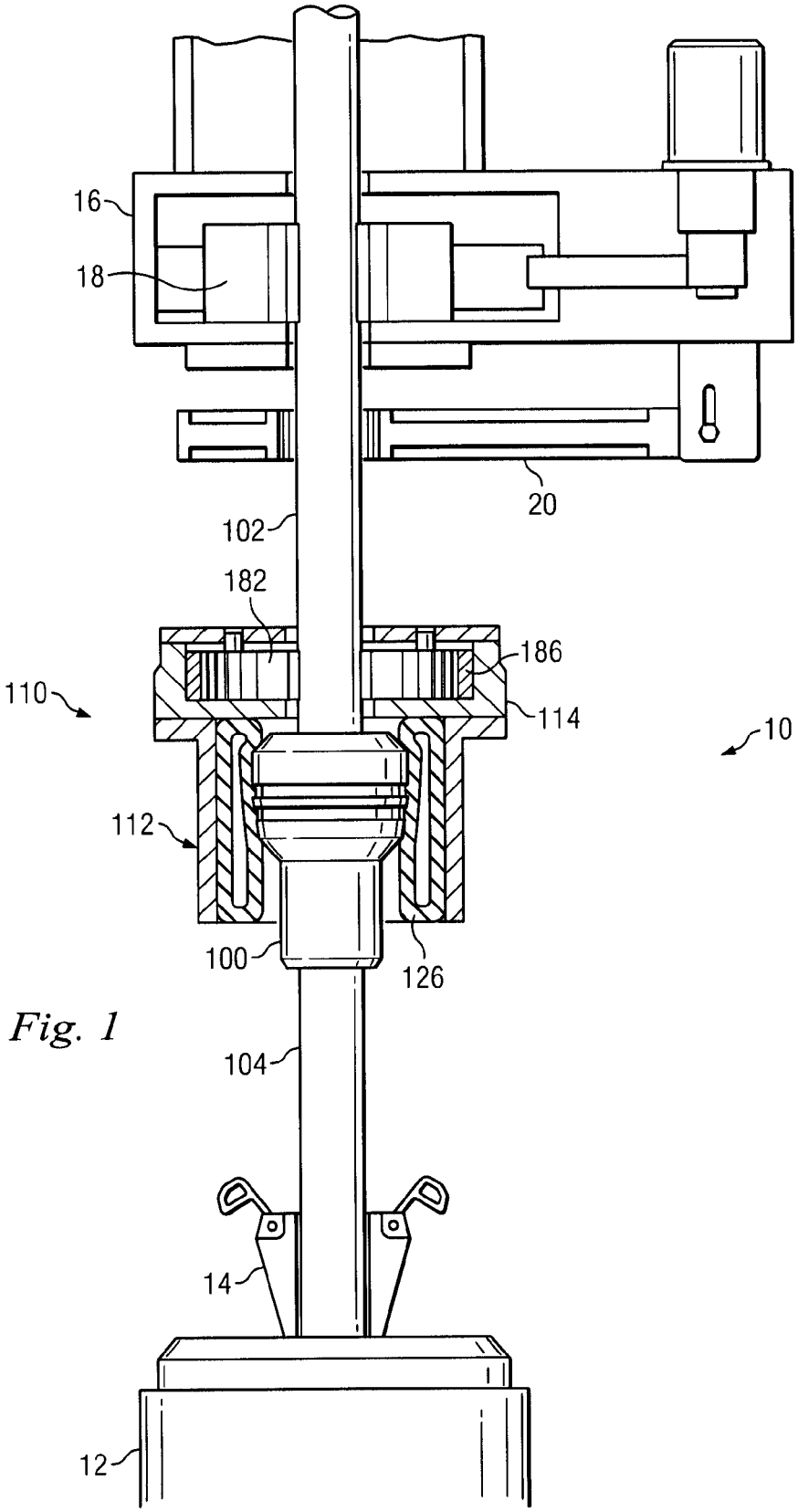
FIG. 1 is a schematic showing a portion of an exemplary service rig with driving elements and a portion of a drill string according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed to a tubing hanging breaker described as a collar assembly arranged to simplify and improve a process for unthreading a desired pipeline segment, such as tubing, from a tubing hanger. Since the tubing hanger can effectively act as a coupler that threadably connects two pipeline segments, such as for example, a tubing segment and a pup joint, torque applied to only one of the pipeline segments or to the tubing hanger may potentially unthread either one of the pipeline segments or both of the pipeline segments. To control which threaded joint will be unscrewed, the collar assembly of this disclosure preferably physically secures one pipeline segment to the tubing hanger so that applied torque acts entirely on the desired threaded connection and does not act on the other threaded connection. To do this, the collar assembly attaches to both the tubing hanger and the pipeline segment to be relatively fixed in place. Since the tubing hanger and the pipeline segment both have cylindrical outer surfaces, the collar assembly may be particularly arranged to affix to a cylindrical surface.

FIG. 1 shows one example of a workover or service rig 10 with a tubing hanger 100 in place between two pipeline segments. For reference and ease of description, this disclosure will refer to the upper pipeline segment as a pup joint 102 and will refer to the lower pipeline segment as tubing 104. It is understood that any type of tubular or other pipe segment may be independently used in place of the tubing hanger, the pup joint, and the tubing disclosed herein. For example, the apparatus of the disclosure may be used for drill collars, drill pipes, rotary kellys, stabilizers, rotary subs, drill bits, or other drilling elements. Further the service rig 10 may be any type of rig, including land-based rigs, jack-up rigs, semisubmersible rigs, drill ship rigs, coiled tubing rigs, and casing drilling rigs, among others.

The exemplary service rig 10 includes a blow-out preventer 12 and slips 14. The tubing 104 extends downwardly from the tubing hanger 100 through the slips 14 and into the blow-out preventer 12. Power tongs 16 include jaws 18 that connect to the pup joint 102. These power tongs 16 may be used to rotate the pup joint 102. Back-up tongs 20 may be disposed below the power tongs 16.

The tubing hanger 100 conventionally would include a threaded opening that receives and threadedly engages threads on the pup joint 102 and includes an opposing threaded opening that receives and threadedly engages threads on the tubing 104.

As shown in FIG. 1, a collar assembly referenced herein by the numeral 110, is disposed about a portion of the tubing hanger 100 and a portion of the pup joint 102. As will be described in detail below, the collar assembly 110 selectively connects to the tubing hanger 100 and pup joint 102 to prevent relative rotation therebetween, thereby preferably maintaining the connection of the tubing hanger 100 and pup joint 102 even under torque loads. With the tubing hanger 100 and pup joint 102 fixed in place relative to each other, torque applied to unthread the tubing hanger according to the present disclosure unthreads the tubing 104, and does not unthread the pup joint 102.

Figure 2:
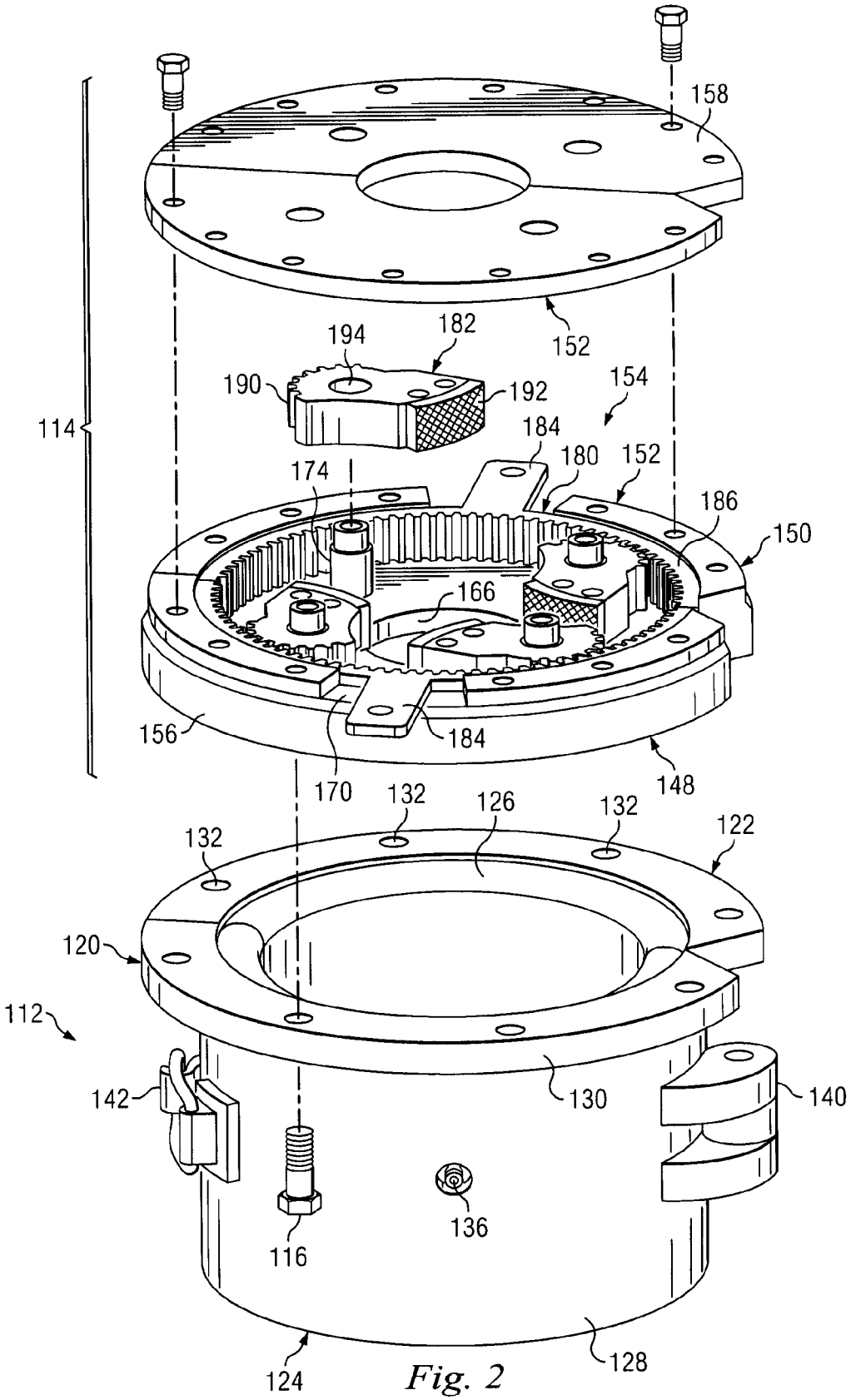
FIG. 2 is an illustration of a partially exploded view of an exemplary collar assembly in a closed position according to one or more aspects of the present disclosure.
Figure 3:
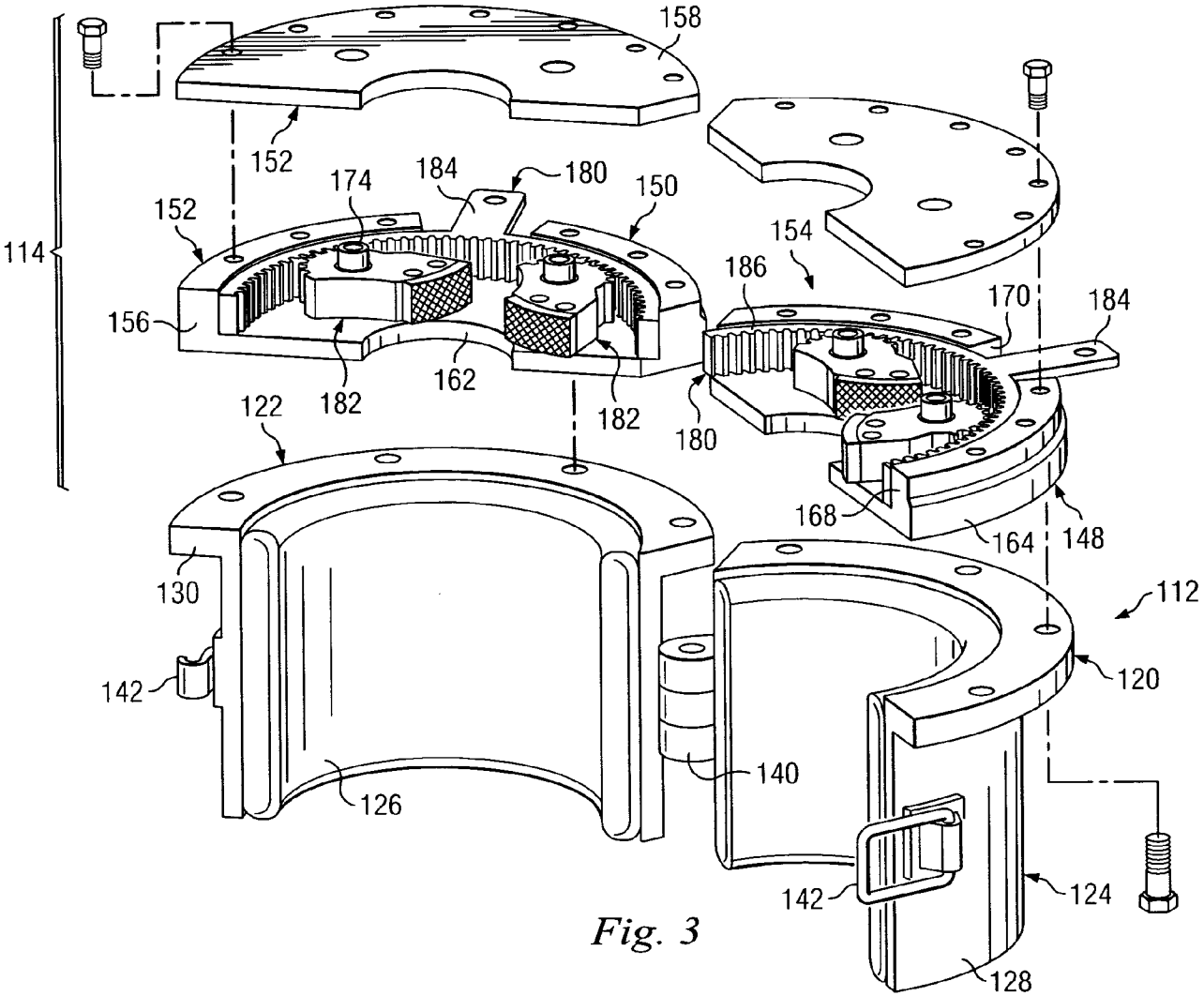
FIG. 3 is an illustration of a partially exploded view of an exemplary collar assembly in an open position according to one or more aspects of the present disclosure.

The collar assembly 110 is described in greater detail below. FIG. 1 shows the collar assembly 110 in cross-section disposed about the tubing hanger 100 and the pup joint 104, FIG. 2 shows the collar assembly 110 in a partially exploded view in a closed position, and FIG. 3 shows the collar assembly 110 in a partially exploded view in an open position.

The collar assembly 110 includes a housing portion referred to as a clamping assembly 112 and a housing portion referred to as a jaw assembly 114. As shown in FIG. 2, the clamping assembly 112 is configured to interface with the tubing hanger 100 and the jaw assembly 114 is configured to interface with the pup joint 102. Although shown exploded for ease of explanation, the clamping assembly 112 and the jaw assembly 114 are fixed together to form a combined system. In the embodiment shown, the clamping assembly 112 and the jaw assembly 114 are fastened together using bolt fasteners 116 in a manner that prevents separation and relative displacement of the clamping assembly 112 and the jaw assembly 114. In other embodiments, one or more alternative fasteners may be used. In one embodiment, the clamping assembly 112 and the jaw assembly 114 are welded together. Other attachment elements and methods are also contemplated. In one embodiment, the clamping assembly 112 and the jaw assembly 114 share the same monolithic housing and therefore do not employ the fasteners or other attachment methods or elements.

In the exemplary embodiment shown, the clamping device 112 includes a first clamshell portion 120 and a second clamshell portion 122 that cooperate to selectively grip the tubing hanger 100. Together, the first and second clamshell portions 120, 122 form a cylindrical clamp. Each of the clamshell portions 120, 122 includes a body 124 and a gripping system described herein as a deformable inner liner 126. For ease of explanation, like components will use the same reference number in the figures. In the example shown, the body 124 comprises a semi-cylindrical portion 128 and a flange 130 disposed at an end of the semi-cylindrical portion 128. The flange 130 in this embodiment includes attachment features 132 shown as bolt holes that enable the clamping assembly 112 to attach to the jaw assembly 114.

The deformable inner liner 126 is preferably formed of a flexible material that reversibly deforms in shape to match the profile or contour of the tubing hanger 100. In one embodiment, the deformable inner liner 126 is a rubber or other natural or synthetic elastomeric liner that deforms under pressure to conform to features of the tubing hanger 100. In one embodiment, the inner liner material is selected to provide flexibility at low temperatures. In another embodiment, the inner liner material is an oil resistant material. Although a rubber or other natural or synthetic elastomeric liner is identified above, other suitable materials for the inner liner 126 are contemplated. Like the body 124 of the clamshell portions 120, 122, the inner liner 126 is semi-cylindrically shaped and may be secured to the inner diameter or the inner curvature of the clamp portion body 124. In one example it is adhered to the body 124 using an adhesive or cement. The clamping device 112 can be secured about the tubing hanger 100 and the inner liner 126 can be urged against the surface of the tubing hanger 100 to reversibly deform and grip against it. In one embodiment, the liner is formed of rubber with friction enhancing features, such as, for example, a plurality of ribs, nubs, or other features that may increase the frictional resistance or increase interference to reduce slippage.

In the embodiment shown, the deformable inner liner 126 is an inflatable elastomeric bladder, such as a natural or synthetic rubber member that may expand when pressurized either hydraulically or pneumatically. Since the inner liner 126 is disposed on the inner side of the body 124 of the clamshell portions 120, 122, inflation expands the inner liner 156 radially inward. As such, it can be driven into greater engagement with the tubing hanger outer surface, regardless of its contour. Once later deflated to retract, the inner liner 126 then preferably can revert at least substantially, and preferably entirely, to its original shape.

Such a system may provide an advantage of resiliently deforming to accommodate cylindrical surfaces of varying diameter and to more particularly conform to variations in the profile or outer body shape of the tubing hanger 100.

FIG. 2 shows a fluid port 136 formed in the body 124 of the first clamshell portion 120. A similar fluid port may be formed in the body of the second clamshell portion 122. Of course, more than two clamshell portions may be used if desired, so long as at least one has a fluid port 136. The fluid port 136 provides access to an interior of the deformable inner liner 126 and may be used to introduce hydraulic or pneumatic fluid into the clamping device 112 to expand the inner liner 126, thereby decreasing the inner diameter of the clamping device 112. Any suitable fluid may be used for this purpose, although preferably it is a sufficiently non-compressive fluid so that it can readily and sufficiently inflate the inner liner 126. In so doing, the inner liner 126 may compress against and frictionally engage an outer surface of the tubing hanger 100. Since it engages about the complete circumference of the tubing hanger 100, it engages over a sufficiently large surface area. Likewise, fluid may be released from the inner liner though the port 136 to deflate the inner liner 126, increasing the inner diameter of the clamping device 112. This may permit the clamshell portions 120, 122 to be more easily opened and closed by removing pressure against the tubing hanger 100 until desired. One embodiment includes discs, pads, or cushions, such as fiber discs that are disposed between the tubing hanger and the inner liner.

The first and second clamshell portions 120, 122 are connected by a hinge 140 that permits them to pivotably open and close. FIG. 2 shows the clamping device 112 in a closed position and FIG. 3 shows the clamping device 112 in an open position. A locking mechanism 142 secures the clamping device 112 in the closed position. In the example shown, the locking mechanism 142 is latch. In other embodiments, however, the locking mechanism 142 may comprise an overcenter hinge or clamp, or one or more of buckles, pin-locks, snaps, belts, or cinches, among other locking mechanisms.

The jaw assembly 114 is arranged to clamp onto or fix itself to the cylindrically shaped outer surface of the pup joint 102. As can be seen in FIG. 1, the pup joint 102 has a diameter smaller than the diameter of the tubing hanger 100. Like the clamping device 112, the jaw assembly 114 is formed of two portions that separate from a closed position to an open position to receive the pup joint 102. In this example, the two portions are referred to as a first clamshell portion 148 and a second clamshell portion 150. In the embodiment shown, these are respectively fixed to the first clamshell portion 120 and the second clamshell portion 122 in the manner discussed above. Each of the first and second clamshell portions 148, 150 includes a housing 152 and a gripping system referenced herein as a jaw system 154. The jaw system 154 is disposed within the housing 154 and selectively grips the cylindrical outer surface of the pup joint 102. The jaw system 154 may be configured in an engaged position that prevents relative rotation of the pup joint 102 and the jaw assembly 114 and it may be configured in a disengaged position that permits relative movement of the pup joint 102 and the jaw assembly 114.

The housing 154 of each clamshell portion 148, 150 includes a bottom plate 156 and a top plate 158. The bottom 156 plate has an inner perimeter 162 having a first radius and an outer perimeter 164 having a larger second radius. When in the closed position shown in FIG. 2, the inner perimeters 162 of the two bottom plates 156 meet to form a central hole 166 through which the pup joint 102 extends when disposed in the jaw assembly 114. The outer perimeter 164 includes a perimeter wall 168 that forms the outer perimeter 164 and serves as a backstop of the bottom plate 156. A passage or gap 170 in the perimeter wall 168 is sized to receive a projecting lever and to permit lateral movement of the lever for displacing a gear rack as will be described below. Each bottom plate 156 also includes pivot pins 174. These serve to place a plurality of individual locking paddles (described below) and define a pivot axis for each of the locking paddles as the jaw assembly 114 moves between the engaged position that rotationally fixes the jaw assembly 114 against the pup joint 102 and a disengaged position where the jaw assembly 114 is not rotationally fixed to the pup joint 102. In one embodiment, the pivot pins 174 are press fit into bores formed into the bottom plate 156. In another embodiment, the pins 174 are threaded into bottom plate 156. The pivot pins 174 may be solid cylindrical pins or may include features facilitating pivoting. In one example, the pivot pins 174 include bearings, such as ball bearings that facilitate pivoting. In another example, the pivot pins 174 include bushings, such as oil-impregnated bushings. In yet another example, the pivot pins 176 or corresponding surface(s) on the locking paddles are formed of a low-friction polymer, such as a polyurethane that may also be graphite impregnated, polyethylene-terephthalate (PETE), polytetrafluoroethylene (PTFE) (also known commercially as TEFLON), or any combination thereof, to facilitate pivoting. Other types of pivot pins are also contemplated.

As can be seen in FIG. 1, the inner diameter formed by the inner perimeters 162 of the bottom plates 156 is smaller than the inner diameter of the clamping device 112. In the example shown, this smaller diameter still accommodates the smaller diameter of the pup joint 102, but does not accommodate the larger diameter of the tubing hanger 100. Because of this, the diametric shape may help a user properly place the collar assembly 110 on the drill string. For example, the collar assembly 110 may be placed upon and may rest upon the tubing hanger before the gripping systems of the collar assembly 110 are actuated. In addition, with the bottom plate 156 projecting inwardly as shown in FIG. 1, the pivot pins 174 may be disposed sufficiently close to the central hole 166 to provide suitable clamping leverage.

The top plate 158 is typically a flat plate acting as a lid that secures the jaw system 154 within the housing 152. The top plate 158 connects to the bottom plate 156 using bolts, other fasteners, or one or more other devices.

The jaw system 154 includes an engagement mechanism 180 and a plurality of locking paddles 182 that cooperate with the housing 154 to inhibit or prevent relative rotation of a pup joint 102 and the jaw assembly 114. The engagement mechanism 180 includes a curved gear rack 184 and a projecting lever 186. The curved gear rack 186 is a semicircular rack having an outer radius substantially similar to the inner radius of the perimeter wall 168 of the bottom plate 156. The projecting lever 186 extends from the gear rack 186 and is sized to extend out of the passage or gap 170 in the perimeter wall 168. The sides of the passage or gap 170 serve as mechanical stops that limit the range of motion of the projecting lever 186, which in turn limits the motion of the gear rack 186. It is worth noting, and will be described with reference to FIGS. 4-1 and 4-2 below, the curved gear racks 186 of the two clamshell portions 148, 150 illustrated herein when taken together form an internal ring gear. Of course, any suitable number of clamshell portions can be used that collectively form an internal ring gear, such as two, three, four, or even five clamshell portions, for example.

The locking paddles 182 are each pivotably disposed on the pivot pins 174 and are configured to pivot into and out of engagement with the pup joint 102. Each of the locking paddles 182 includes a gear engagement end 190, a gripping end 192, and a pivot bore 194. The pivot bore 194 receives the pivot pin 174, preventing translation of the locking paddles 182 relative to the housing 154 of the jaw assembly 114. This restriction on translation also prevents the engagement mechanism 180 from lateral displacement. Instead, it is disposed between the locking paddles 182 and the perimeter wall 168 in a manner that provides rotational sliding but not radial displacement.

Figures 1, 4:
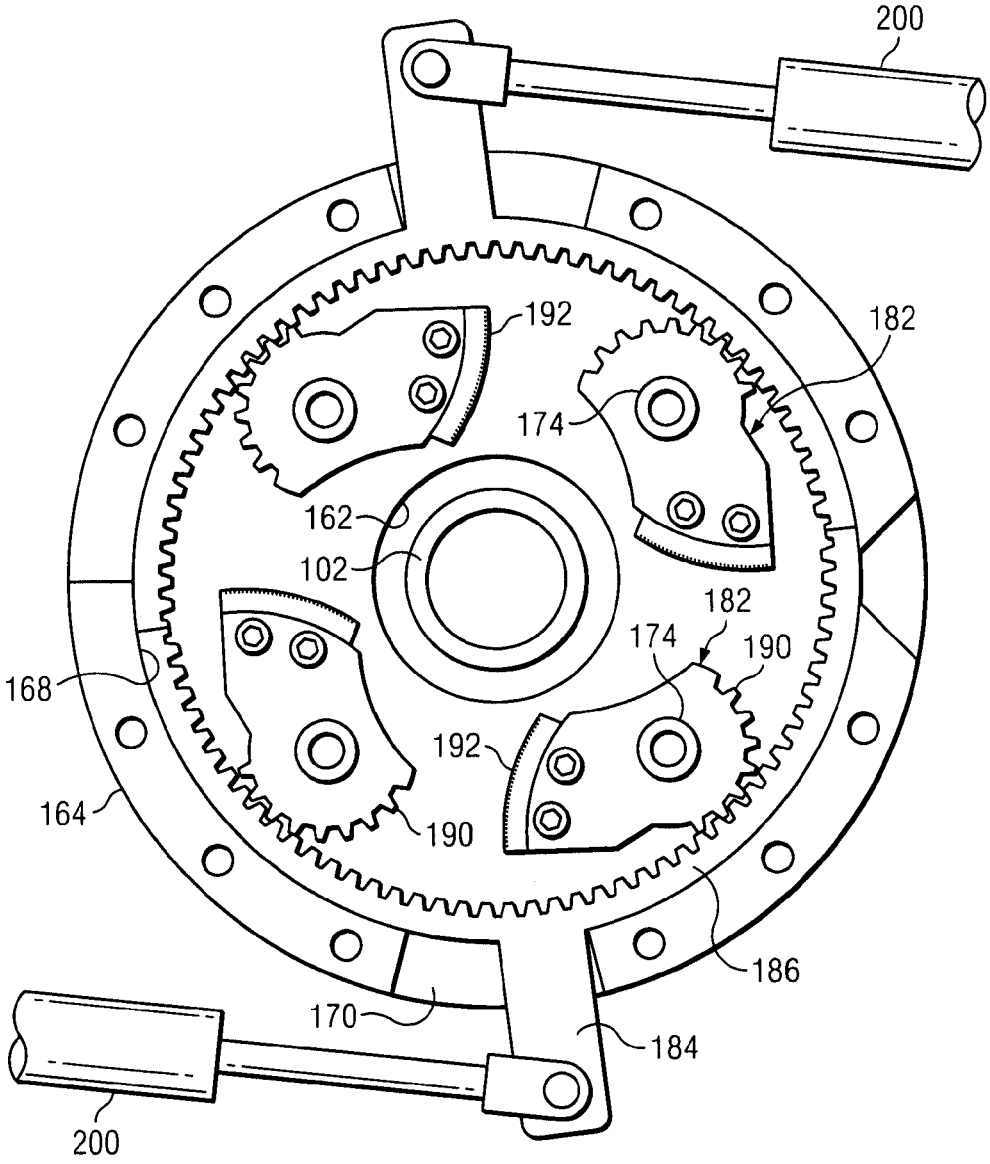
Figures 2, 4:
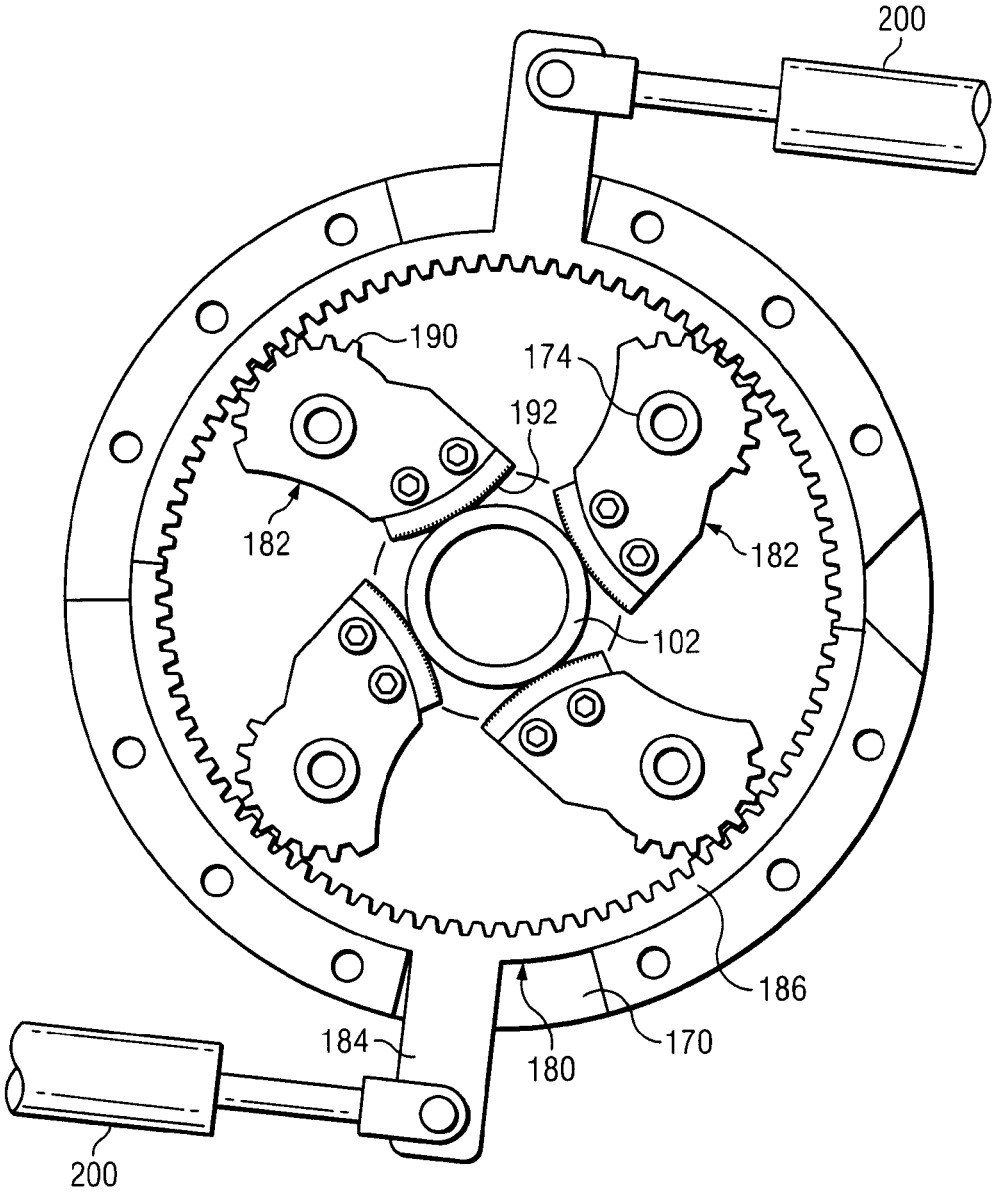

The gear engagement end 190 engages gear teeth on the curved gear rack 186. Accordingly, rotational displacement of the engagement mechanism 180 causes rotation of the gear engagement end 190, which in turn causes the locking paddles 182 to pivot about the pivot pin 174. This can be seen in FIGS. 4-1 and 4-2. FIG. 4-1 shows the jaw system 154 in a disengaged position, with the locking paddles 182 pivoted to a position that will place them out of contact with the pup joint 102. FIG. 4-2 shows the jaw system 154 in an engaged position, with the locking paddles 182 pivoted to a position that will place them in contact with the pup joint 102. Referring to these figures, the gripping end 192 of each of the locking paddles 182 extends radially inward beyond the inner perimeter 162 of the bottom plate 156. Because the locking paddles 182 are rigid, rotational movement about the pivot pin 174 at the gear engagement end 190 results in rotational movement at the gripping end 192. As such, by rotationally moving the engagement mechanism 180, a user can displace the gripping end 192. Because of the pivoting arrangement, the gripping end 192 can pivot into and out of engagement with the cylindrical outer surface of the pup joint 102. In one embodiment, the gripping end 192 is cam shaped and the locking paddles 182 are disposed to provide tighter gripping strength during periods of time when torque is applied to the pup joint 102. As can be seen, the shape of the gripping end 192 may be designed to provide greater resistance to rotation in one direction than the other.

In the embodiment shown, each of the first and second clamshell portions 148, 150 includes two locking paddles 182 for a total of four locking paddles 182. These are disposed so that the locking paddles 182 are spaced ninety degrees apart when engaged with the pup joint 102. Accordingly, the force applied by the four locking paddles 182 secures the collar assembly 110 in a position where the pup joint 102 is centrally disposed in the hole 166 in the housing 152. Other embodiments include fewer locking paddles 182 and yet other embodiments include a greater number of locking paddles 182. One embodiment includes three locking paddles 182. Yet another embodiment includes two moveable locking paddles 182 and a fixed support structure that together form a three-point contact arrangement. With the locking paddles 182 engaged, a user may apply loading on the projecting lever 184 to displace the gear rack 186, displacing the gear engagement end 190 of the locking paddles 182 and causing the locking paddles 182, to pivot about the pivot pin 174 causing a simultaneously displacement of the gripping end 192 to engage the pup joint 102.

FIGS. 4-1 and 4-2 show actuators 200 associated with the projecting lever 184 of the engagement mechanism 180. A user may control the actuators 200 to apply loading to the projecting lever 184 to move the engagement mechanism 180. The exemplary actuator 200 shown is a pneumatic cylinder. It is controlled using an input mechanism that controls pressure and airflow to the actuator 200. Other actuators include hydraulic actuators. Any actuator may be used to displace the engagement mechanism 180. Although shown with an actuator, one embodiment is controlled manually my enabling a user to grasp the projecting lever 184 and manually displace the engagement mechanism 180.

The jaw assembly 114 is thus formed to grip the cylindrical outer surface of the pup joint 102 such that any motion of the pup joint 102, for example as driven by the power tongs 16 (FIG. 1), is conveyed to the locking paddles 182 and thereby to the jaw assembly 114. The jaw assembly 114 therefore is rotationally moved with the pup joint 102. It is rigidly connected to a top end of the clamping device 112 such that any rotational movement of the jaw assembly 114 results in corresponding rotation of the clamping device 112.

One embodiment of the jaw assembly 114 includes locking mechanisms (not shown) usable to lock the first and second clamshell portions 148, 150 in the closed position. These locking mechanisms may be used to replace or to supplement the locking mechanism 142 used to secure the clamping device 112 in a closed position. In one embodiment, the locking mechanisms on the first and second clamshell portions are over center latches that are connected to the sides or the top plates of the first and second clamshell portions 148, 150. Other locking mechanisms may be used as discussed above.

In operation, the tubing 104 (FIG. 1) is secured against rotation using the slips 14, the blow-out preventer 12, or other structural element on the rig 10. The collar assembly 110, including the clamping device 112 and the jaw assembly 114, is placed in an open position by separating the first clamshell portions 120, 148 from the second clamshell portions 122, 150. This may be done simultaneously, as the first clamshell portion 120 may be rigidly connected or may be integral with the first clamshell portion 148, and similarly, the second clamshell portion 122 may be rigidly connected or may be integral with the second clamshell portion 150. In the exemplary embodiment shown, the single hinge 140 on the clamping device 112 enables hinged opening and closing of the whole collar assembly 110.

When the collar assembly 110 is in the open position, it may be placed around the tubing hanger 100 and the pup joint 102 by introducing the tubing hanger 100 and the pup joint 102 laterally through the open side. With the collar assembly 110 in place, the first and second clamshell portions 120, 122 and the first and second clamshell portions 148, 150 may be closed so that the tubing hanger 100 is disposed at least partially within the clamping device 112 and the pup joint 102 is disposed within or passes through the jaw assembly 114. In one embodiment, introducing the pup joint 102 and tubing hanger 100 may include resting the bottom plate 156 of the jaw assembly 114 against a top of the tubing hanger 100 to help position the collar assembly 110 in place.

In embodiments where the inner liner 126 is an elastomeric material, without more, the process of closing the clamping device 112 may compress the inner liner 126 against the outer surface of the tubing hanger 100. These embodiments may include ratchet or cinch mechanisms to tighten the first and second clamshell portions 120, 122 sufficiently against the tubing hanger 100 to provide a sufficient frictional gripping force on the tubing hanger 100. In embodiments where the inner liner 126 can be expanded, such as through inflation of the inner liner 126, the process of closing the clamping device 112 may require less initial force. With the clamping device 112 closed, the locking mechanism 142 may be used to prevent subsequent opening.

With the clamping device locked closed, in embodiments where the inner liner 126 may be expanded or inflated, an expansion fluid, whether hydraulic or pneumatic, is introduced into a cavity in the inner liner 126. In one embodiment the fluid ports 136 of the clamshell portions 120, 122 are connected to a common fluid supply line. So doing enables the pressure in each of the inner liners 126 to be maintained as substantially equal. The inner liner 126 inflates or expands under the introduced pressure to conform to the shape of the tubing hanger 100. Pressure on the tubing hanger 100 increases the frictionally resistance, effectively gripping the tubing hanger 100 with the inner liner 126. Some inner liner embodiments include friction enhancing features, such as ribs, nubs, or other features that may increase the frictional resistance or increase interference to reduce slippage.

In one example, the back-up tong air supply is used as a pneumatic pressure source to inflate the inner liner 126. In this embodiment, the back-up tong air supply may be located in the proximity of the collar assembly 110 on the back-up tongs 20. The air hose is disconnected from the back-up tongs, and the air hose is connected to a fluid line to inflate the inner liner 126 about the tubing hanger 100. When inflated, the inner liner 126 contorts to the shape of the tubing hanger's outer surface. Although the air pressure on the service rig 10 may be low, the surface contact is sufficient to drive the inner liner 126 into engagement with the tubing hanger 100.

With the clamping device 112 now securely connected to the tubing hanger 100, the jaw assembly 114 is actuated to engage the pup joint 102. Actuation of the jaw assembly 114 includes moving the engagement mechanism 180 to displace the locking paddles 182 from a disengaged position to an engaged position. In one embodiment, a user displaces the projecting lever 184 of the engagement mechanism 180 to correspondingly displace the gear rack 186. The projecting lever 184 of each of the clamshell portions 148, 150 may be displaced separately, or alternatively, they may be displaced simultaneously. In one embodiment, only a single engagement mechanism 180 is employed for the jaw assembly 114. In this example, the gear racks 186 of the two clamshell portions 148, 150 abut at their ends. Because the ends abut, rotation of one of the gear racks 186 may result in corresponding sliding movement of the other. In one embodiment, the projecting levers 184 are displaced using the actuator 200. These may be controlled by the user. In one example each projecting lever 184 of the clamshell portions 148, 150 is connected with a separate actuator 200 as shown in FIGS. 4-1 and 4-2. In one embodiment, the actuators 200 are connected to a common fluid line. This enables the actuators 200 to be subjected to the same levels of pressure and may provide substantially equal actuator displacement and therefore, equal projecting lever 184 displacement. In one example, the actuator 200 may be driven by air from the tong's backup air supply in the manner discussed above.

As the projecting lever 184 displaces, the gear rack 186 rotates within the housing 152. Gear teeth on the gear rack 186 cause gear teeth on the gear engagement end 190 of the locking paddles 182 to displace. This causes the locking paddles 182 to rotate about the pivot pins 174, thereby swinging the gripping end 192 of the locking paddles 182 into engagement with the pup joint 102. Additional pressure on the projecting lever 184 tightens the engagement, increasing the frictional resistance to relative rotation between the pup joint 102 and the jaw assembly 114.

After affixing the collar assembly 110 about the pup joint 102 and the tubing hanger 100, the power tongs (FIG. 1) may be driven to apply torque to the pup joint 102. The torque is conveyed through the jaw assembly 114 to the clamping device 112 and therethrough to the tubing hanger 100. Since the lower tubing string 104 is held securely by the rig 10, the applied torque drives the bottom connection of the tubing hanger 100 to unthread or break out. In summary, the collar assembly 110 acts to grip both the pup joint 102 and the tubing hanger 100 and acts to force them to rotate together. Therefore, torque applied to the pup joint 102 rotates the tubing hanger 100 and breaks the threaded connection of the tubing 104 and the tubing hanger 100.

The collar assembly 110 is arranged such that the jaw assembly 114 engages or grips the smaller outer diameter pup joint 102 and the clamping device 112 engages or grips the larger outer diameter tubing hanger 100. One advantage of employing the clamping device 112 about the larger diameter element of the drill string is that the overall diameter of the collar assembly 110 can be minimized. The use of locking paddles on the tubing hanger 100 would require that the collar assembly 110 have a much larger diameter than is required by using the inner liner 176. In addition, the multipart construction allows the jaw assembly 114 and the clamping device 112 to work cooperatively, together being installable on the tubing hanger 100 and the pup joint 102 by opening and laterally receiving the tubing hanger 100 and the pup joint 102.

Although the clamping device 112 and jaw assembly 114 are shown as being able to be opened and wrapped around the pup joint 102 and tubing hanger 100, other embodiments do not open and close and may require the pup joint 102 and tubing hanger 100 to be inserted through an end of the collar assembly 110.

The apparatus and system of the present disclosure can provide many advantages over the conventional system of pipe wrenches connected by a chain. For example, because of the self-contained nature of the collar assembly 110, failure of components may be maintained within the body or housings. In addition, embodiments of the clamping device 112 using inflatable liners may be able to secure and frictionally inhibit or prevent movement over a wide variety of shapes and sizes without requiring manual adjustment of the width of wrench openings.

In view of all of the above and the figures, one of ordinary skill in the art will readily recognize that the present disclosure introduces an apparatus that includes a first housing portion comprising a first adjustable gripping system moveable between an engaged position that grips a cylindrical outer surface of a first tubular structure having a first diameter and a disengaged position that permits relative movement of the first housing portion and the first tubular structure. The apparatus also includes a second housing portion fixed relative to the first housing portion so that rotation of the first housing portion results in rotation of the second housing portion. The second housing portion includes a second gripping system to securely grip a cylindrical outer surface of a second tubular structure that is threadably attached to the first tubular structure and that has a second diameter different than the first diameter.

In one aspect, the second gripping system comprises a reversible deformable liner disposed to engage and grip the cylindrical outer surface of the second tubular structure. In another aspect, the second gripping system is an adjustable gripping system comprising an inflatable bladder disposed in and fixed to the second housing portion, the inflatable bladder being inflatable from a first position that allows movement of the second tubular structure relative to the second housing portion to a second position that inhibits or prevents movement of the second tubular structure relative to the second housing portion. In another aspect, the first adjustable gripping system of the apparatus comprises a plurality of locking paddles configured to selectively grip the first tubular structure, the plurality of locking paddles being moveable from a first position that allows relative movement of the first tubular structure to a second position inhibiting or preventing relative movement of the first tubular structure. In yet another aspect, the first adjustable gripping system comprises a curved gear rack, the plurality of locking paddles each having an end engaging the curved gear rack, the gear rack being moveable to pivot the plurality of locking paddles to securely grip the cylindrical outer surface of the first tubular structure. In another aspect, the curved gear rack being an internal ring gear. In one aspect, the first adjustable gripping system comprises a plurality of locking paddles configured to selectively grip the first tubular structure. The apparatus also includes an engagement mechanism actuatable to displace the plurality of locking paddles from a first position that allows relative movement of the first tubular structure to a second position inhibiting or preventing relative movement of the first tubular structure. In another aspect, the engagement mechanism comprises a gear rack and a projecting lever, the projecting lever projecting externally from the first housing portion and being actuatable to displace the gear rack to displace the locking paddles from the first position to the second position. In one aspect, an actuator attaches to the projecting lever to actuate the engagement mechanism. In one aspect, the first housing portion comprises a first clamshell portion and a second clamshell portion pivotable relative to the first clamshell portion from an open position that permits lateral insertion of the first tubular structure to a closed position that inhibits or prevents removal of the first tubular structure. In one aspect, the apparatus further comprises a locking mechanism to selectively connect the first clamshell portion to the second clamshell portion to selectively secure the first housing portion in the closed position. In another aspect, the second housing portion comprises a first clamshell portion, a second clamshell portion, and a hinge pivotably connecting the first clamshell portion to the second clamshell portion. The hinge permits the first clamshell portion to pivot relative to the second clamshell portion from an open position that permits lateral insertion of the second tubular structure to a closed position that preferably prevents removal of the second tubular structure. In one aspect, the hinge comprises a pin hinge. In another aspect, a locking mechanism selectively connects the first clamshell portion to the second clamshell portion to selectively secure the second clamshell portion in the closed position. In yet another aspect, the first and second housing portions are monolithic.

The present disclosure also introduces an apparatus that includes a first housing portion comprising a first adjustable gripping system actuatable between an engaged position that grips a cylindrical outer surface of a first tubular structure having a first diameter and a disengaged position that permits relative movement of the first housing portion and the first tubular structure. The gripping system comprises a plurality of locking paddles and an engagement mechanism operable to advance and retract the plurality of locking paddles. The apparatus also includes a second housing portion fixed relative to the first housing portion so that rotation of the first housing portion results in rotation of the second housing portion. The second housing portion comprises a second adjustable gripping system to securely grip a cylindrical outer surface of a second tubular structure that is threadably attached to the first tubular structure and that has a second diameter different than the first diameter. The second gripping system comprises an inflatable bladder operable to increase frictional resistance and inhibit or prevent relative rotation of the second housing portion and the second tubular structure.

In one aspect, the first adjustable gripping system comprises a curved gear rack. The locking paddles each have an end engaging the curved gear rack. The gear rack is moveable to pivot the plurality of locking paddles to securely grip the cylindrical outer surface of the first tubular structure. In another aspect, the curved gear rack is an internal ring gear. In another aspect, the first adjustable gripping system comprises an engagement mechanism actuatable to displace the plurality of locking paddles from the disengaged position to the engaged position. In yet another aspect, the engagement mechanism comprises a gear rack and a projecting lever. The projecting lever projects externally from the first housing portion and is actuatable to displace the gear rack to displace the plurality of locking paddles from the disengaged position to the engaged position. In one aspect, an actuator is attached to the projecting lever to actuate the engagement mechanism. In another aspect, the first housing portion comprises a first clamshell portion and a second clamshell portion pivotable relative to the first clamshell portion from an open position that permits lateral insertion of the first tubular structure to a closed position that inhibits or prevents removal of the first tubular structure. In yet another aspect, a locking mechanism selectively connects the first clamshell portion to the second clamshell portion to selectively secure the first housing portion in the closed position. In one aspect, the second housing portion comprises a first clamshell portion, a second clamshell portion, and a hinge pivotably connecting the first clamshell portion to the second clamshell portion. The hinge permits the first clamshell portion to pivot relative to the second clamshell portion from an open position that permits lateral insertion of the second tubular structure to a closed position that inhibits or prevents removal of the second tubular structure. In another aspect, the hinge comprises a pin hinge. In one aspect, a locking mechanism selectively connects the first clamshell portion to the second clamshell portion to selectively secure the second clamshell portion in the closed position.

The present disclosure also introduces an apparatus that includes a jaw assembly comprising a first adjustable jaw system actuatable between an engaged position that grips a cylindrical outer surface of a first tubular structure having a first diameter and a disengaged position that permits relative movement of the jaw assembly and the first tubular structure. The jaw system comprises a pivot pin and a plurality of locking paddles having a gear engagement end and a gripping end. The plurality of locking paddles are each pivotable about a pivot pin. The jaw assembly also includes an engagement mechanism comprising a gear rack. The gear engagement end of the plurality of locking paddles engages the gear rack. The gear rack is moveable relative to the plurality of locking paddles to pivot the locking paddles about the pivot pin to advance and retract the gripping end toward and away from the first tubular structure. The apparatus also includes a clamping device fixed relative to the jaw assembly so that rotation of the jaw assembly results in rotation of the clamping device. The clamping device comprises an inflatable bladder operable in an inflated condition to securely grip a cylindrical outer surface of a second tubular structure that is threadably attached to the first tubular structure and that has a second diameter different than the first diameter. The jaw assembly and the clamping device are divided into a first clamshell portion and a second clamshell portion that is pivotable relative to the first clamshell portion from an open position that permits lateral insertion of the first and second tubular structures to a closed position that inhibits or prevents removal of the first and second tubular structures. In one aspect, an actuator is associated with the engagement mechanism to displace the engagement mechanism and advance and retract the gripping end toward and away from the first tubular structure. In another aspect, the inflatable bladder comprises a first bladder associated with the first clamshell portion and a second bladder associated with the second clamshell portion.

The present disclosure also introduces a method that comprises introducing a first tubular structure into a first housing portion, and introducing a second tubular structure into a second housing portion that is rotationally fixed to the first housing portion. The first tubular structure has a first diameter and the second tubular structure has a second diameter, and the first and second tubular structures are threadably connected to each other. The method also comprises actuating a first adjustable gripping system from a disengaged position that permits relative movement of the first housing portion and the first tubular structure to an engaged position that grips a cylindrical outer surface of the first tubular structure and inhibits or prevents relative movement of the first housing portion and the first tubular structure. The method also comprises gripping a cylindrical outer surface of the second tubular structure to prevent unthreading of the first and second tubular structures.

In one aspect, the method comprises securing a third tubular structure in place, the third tubular structure being threadably connected to the second tubular structure. The method comprises applying torque to one of the first and third tubular structures to unthread the third tubular structure from the second tubular structure while the first and second housing portions inhibit or prevent the first tubular structure from unthreading from the second tubular structure. In another aspect, the method is comprised of gripping a cylindrical outer surface of the second tubular structure that comprises engaging the cylindrical outer surface of the tubular structure with a reversible deformable inner liner. In yet another aspect, the method comprises inflating the inner liner radially inward to engage the outer surface of the second tubular member. In one aspect, inflating the inner liner comprises inflating first and second opposing inner liners. In one aspect, inflating the inner liner comprises detaching an air supply from back-up tongs and attaching the air supply to the second tubular structure. In yet another aspect, the method comprises actuating a first adjustable gripping system comprising the displacing of an engagement mechanism to advance locking paddles and engaging the first tubular structure with the locking paddles. In one aspect, the method displaces the engagement mechanism that is comprised of sliding a curved gear rack within the first housing portion to advance the locking paddles. In another aspect, the method comprises locking paddles having ends with gear teeth engaged with gear teeth on the gear rack, and wherein sliding a curved gear rack displaces the locking paddles ends with gear teeth so that the locking paddles pivot about an axis into the engaged position. In one aspect, displacing the engagement mechanism comprises actuating a projecting lever of the engagement mechanism that projects out from the first housing portion. In another aspect, introducing a first tubular structure and introducing a second tubular structure are simultaneously performed.

The present disclosure also introduces a method comprised of introducing a first pipeline segment into a jaw assembly, and introducing a tubing hanger into a clamping device that is rotationally and rigidly fixed to the jaw assembly. The first pipeline segment has a first diameter and the tubing hanger has a second diameter. The first pipeline segment and the tubing hanger are threadably connected to each other. The method comprises actuating a first adjustable gripping system from a disengaged position that permits relative movement of the jaw assembly and the first pipeline segment to an engaged position that grips a cylindrical outer surface of the first pipeline segment and inhibits or prevents relative movement of the jaw assembly and the first pipeline segment. The method also comprises gripping a cylindrical outer surface of the tubing hanger to preferably prevent unthreading of the first pipeline segment and the tubing hanger. The method comprises securing a second pipeline segment in place, the second pipeline segment being threadably connected to the tubing hanger. The method comprises applying torque to the first pipeline segment to unthread the second pipeline segment from the tubing hanger while the jaw assembly and the clamping device inhibit or prevent the first pipeline segment from unthreading from the tubing hanger.

In one aspect, gripping a cylindrical outer surface of the tubing hanger comprises inflating an inflatable liner of the clamping device until the liner engages the tubing hanger. In another aspect, actuating a first adjustable gripping system comprises displacing a gear rack to advance locking paddles and engage the locking paddles with the first pipeline segment. In another aspect, the first pipeline segment is a pup joint and the second pipeline segment is a tubing segment.

The present disclosure also introduces an apparatus comprising: a first housing portion comprising a first gripping system moveable between an engaged position and a disengaged position, wherein: in the engaged position, the first gripping system grips a cylindrical outer surface of a first tubular structure having a first diameter; and in the disengaged position, relative movement between the first housing portion and the first tubular structure occurs; and a second housing portion fixed relative to the first housing portion and comprising a second gripping system to securely grip a cylindrical outer surface of a second tubular structure that is threadably attached to the first tubular structure, wherein the cylindrical outer surface of the second tubular structure has a second diameter different than the first diameter. The second gripping system may comprise a liner that is reversibly deformable to grip the cylindrical outer surface of the second tubular structure. The second gripping system may be an adjustable gripping system comprising an inflatable bladder fixed to the second housing portion, and the inflatable bladder may be inflatable from a first position, that allows movement of the second tubular structure relative to the second housing portion, to a second position, that prevents movement of the second tubular structure relative to the second housing portion. The first gripping system may comprise a plurality of locking paddles collectively configured to selectively grip the first tubular structure, and the locking paddles may be moveable between a first position, that allows relative movement of the first tubular structure, and a second position, that inhibits or prevents relative movement of the first tubular structure. The first gripping system may comprise a curved gear rack, the plurality of locking paddles may each have an end engaging the curved gear rack, and the gear rack may be moveable to pivot the plurality of locking paddles to securely grip the cylindrical outer surface of the first tubular structure. The curved gear rack may be an internal ring gear. The first gripping system may comprises: a plurality of locking paddles to selectively grip the first tubular structure; and an engagement mechanism to displace the plurality of locking paddles from a first position that allows relative movement of the first tubular structure to a second position inhibiting or preventing relative movement of the first tubular structure. The engagement mechanism may comprise a gear rack and a projecting lever, the projecting lever may project externally from the first housing portion, and the projecting lever may be to displace the gear rack to displace the plurality of locking paddles from the first position to the second position. At least one of the first and second housing portions may comprise pivotably connected first and second clamshell portions. The first and second housing portions may each be monolithic.

The first gripping system may be a first adjustable gripping system comprising a plurality of locking paddles and an engagement mechanism operable to advance and retract the plurality of locking paddles; and the second gripping system may be a second adjustable gripping system comprising a reversibly inflatable bladder. The first adjustable gripping system may comprise a curved gear rack, the plurality of locking paddles may each have an end engaging the curved gear rack, and the gear rack may be moveable to pivot the plurality of locking paddles to grip the cylindrical outer surface of the first tubular structure. At least one of the first and second housing portions may comprise pivotably connected first and second clamshell portions. The reversibly inflatable bladder may comprise a first bladder associated with the first clamshell portion and a second bladder associated with the second clamshell portion.

The present disclosure also introduces a method comprising: introducing a first tubular structure into a first housing portion comprising a first gripping system; introducing a second tubular structure into a second housing portion comprising a second gripping system, wherein the second housing portion is rotationally fixed to the first housing portion, wherein the first tubular structure has a first diameter, wherein the second tubular structure has a second diameter different than the first diameter, and wherein the first and second tubular structures are threadably connected to each other; actuating the first gripping system from a disengaged position, that permits relative movement of the first housing portion and the first tubular structure, to an engaged position, that grips a cylindrical outer surface of the first tubular structure and inhibits or prevents relative movement of the first housing portion and the first tubular structure; gripping a cylindrical outer surface of the second tubular structure to prevent unthreading of the first and second tubular structures; securing a third tubular structure threadably connected to the second tubular structure; and applying torque to one of the first and third tubular structures to unthread the third tubular structure from the second tubular structure while the first and second housing portions prevent the first tubular structure from unthreading from the second tubular structure. Gripping the cylindrical outer surface of the second tubular structure may comprise engaging the cylindrical outer surface of the second tubular structure with a reversibly deformable inner liner by inflating the reversibly deformable inner liner. Inflating the reversibly deformable inner liner may comprise inflating opposing first and second reversibly deformable inner liners. Actuating the first gripping system may comprise displacing an engagement mechanism to advance a plurality of locking paddles to engage the first tubular structure with the plurality of locking paddles. Introducing the first tubular structure and introducing the second tubular structure may be simultaneously performed. One of the first and second tubular structures may be a pipe segment, and the other of the first and second tubular structures may be a liner hanger.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. An apparatus, comprising:

a first housing portion comprising a first gripping system moveable between an engaged position and a disengaged position, wherein:

in the engaged position, the first gripping system grips a cylindrical outer surface of a first tubular structure having a first diameter; and in the disengaged position, relative movement between the first housing portion and the first tubular structure occurs; and a second housing portion rotationally fixed relative to the first housing portion in a manner that prevents relative rotation between the first and second housing portions, the second housing portion comprising a second gripping system fixed relative to the first gripping system in a manner that prevents relative rotation between the first and second gripping systems, the second gripping system being structurally arranged to securely grip a cylindrical outer surface of a second tubular structure that is threadably attached to the first tubular structure, wherein the cylindrical outer surface of the second tubular structure has a second diameter different than the first diameter.

2. The apparatus of claim 1 wherein the second gripping system comprises a liner that is reversibly deformable to grip the cylindrical outer surface of the second tubular structure.

3. The apparatus of claim 1 wherein the second gripping system is an adjustable gripping system comprising an inflatable bladder fixed to the second housing portion, and wherein the inflatable bladder is inflatable from a first position, that allows movement of the second tubular structure relative to the second housing portion, to a second position, that prevents movement of the second tubular structure relative to the second housing portion.

4. The apparatus of claim 1 wherein the first gripping system comprises a plurality of locking paddles collectively configured to selectively grip the first tubular structure, and wherein the locking paddles are moveable between a first position, that allows relative movement of the first tubular structure, and a second position, that inhibits or prevents relative movement of the first tubular structure.

5. The apparatus of claim 4 wherein the first gripping system comprises a curved gear rack, wherein the plurality of locking paddles each have an end engaging the curved gear rack, and wherein the gear rack is moveable to pivot the plurality of locking paddles to securely grip the cylindrical outer surface of the first tubular structure.

6. The apparatus of claim 5 wherein the curved gear rack is an internal ring gear.

7. The apparatus of claim 1 wherein the first gripping system comprises:

a plurality of locking paddles to selectively grip the first tubular structure; and an engagement mechanism to displace the plurality of locking paddles from a first position that allows relative movement of the first tubular structure to a second position inhibiting or preventing relative movement of the first tubular structure.

8. The apparatus of claim 7 wherein the engagement mechanism comprises a gear rack and a projecting lever, wherein the projecting lever projects externally from the first housing portion, and wherein the projecting lever is to displace the gear rack to displace the plurality of locking paddles from the first position to the second position.

9. The apparatus of claim 1 wherein at least one of the first and second housing portions comprises pivotably connected first and second clamshell portions.

10. The apparatus of claim 1 wherein the first and second housing portions are each monolithic.

11. The apparatus of claim 1 wherein:

the first gripping system is a first adjustable gripping system comprising a plurality of locking paddles and an engagement mechanism operable to advance and retract the plurality of locking paddles; and the second gripping system is a second adjustable gripping system comprising a reversibly inflatable bladder.

12. The apparatus of claim 11 wherein the first adjustable gripping system comprises a curved gear rack, wherein the plurality of locking paddles each have an end engaging the curved gear rack, and wherein the gear rack is moveable to pivot the plurality of locking paddles to grip the cylindrical outer surface of the first tubular structure.

13. The apparatus of claim 11 wherein at least one of the first and second housing portions comprises pivotably connected first and second clamshell portions.

14. The apparatus of claim 13 wherein the reversibly inflatable bladder comprises a first bladder associated with the first clamshell portion and a second bladder associated with the second clamshell portion.

15. A method, comprising:

introducing a first tubular structure into a first housing portion comprising a first gripping system;

introducing a second tubular structure into a second housing portion comprising a second gripping system, wherein the second housing portion is rotationally fixed to the first housing portion, wherein the first tubular structure has a first diameter, wherein the second tubular structure has a second diameter different than the first diameter, and wherein the first and second tubular structures are threadably connected to each other;

actuating the first gripping system from a disengaged position, that permits relative movement of the first housing portion and the first tubular structure, to an engaged position, that grips a cylindrical outer surface of the first tubular structure and inhibits or prevents relative movement of the first housing portion and the first tubular structure;

gripping a cylindrical outer surface of the second tubular structure to prevent unthreading of the first and second tubular structures;

securing a third tubular structure threadably connected to the second tubular structure; and applying torque to one of the first and third tubular structures to unthread the third tubular structure from the second tubular structure while the first and second housing portions prevent the first tubular structure from unthreading from the second tubular structure.

16. The method of claim 15 wherein gripping the cylindrical outer surface of the second tubular structure comprises engaging the cylindrical outer surface of the second tubular structure with a reversibly deformable inner liner by inflating the reversibly deformable inner liner.

17. The method of claim 16 wherein inflating the reversibly deformable inner liner comprises inflating opposing first and second reversibly deformable inner liners.

18. The method of claim 15 wherein actuating the first gripping system comprises displacing an engagement mechanism to advance a plurality of locking paddles to engage the first tubular structure with the plurality of locking paddles.

19. The method of claim 15 wherein introducing the first tubular structure and introducing the second tubular structure are simultaneously performed.

20. The method of claim 15 wherein one of the first and second tubular structures is a pipe segment, and wherein the other of the first and second tubular structures is a liner hanger.

21. An apparatus for preventing unthreading of a tubular structure from a tubing hanger, comprising:

a rigid support structure;

a first gripping system carried on the rigid support structure and moveable between an engaged position and a disengaged position, wherein:

in the engaged position, the first gripping system is structurally arranged to grip a cylindrical outer surface of the tubular structure, the tubular structure having a first diameter, and in the disengaged position, the first gripping system is structurally arranged to permit relative movement between the first gripping system and the tubular structure; and a second gripping system carried on the rigid support structure and fixed in place relative to the first gripping system via the rigid support structure in a manner that prevents all rotational displacement and all axial displacement of the second gripping system relative to the first gripping system, the second gripping system being structurally arranged to securely grip a cylindrical outer surface of the tubing hanger when it is threadably attached to the tubular structure, wherein the cylindrical outer surface of the tubing hanger has a second diameter different than the first diameter of the tubular structure, the first and second gripping systems being mechanically configured to prevent the tubular structure from unthreading from the tubing hanger.

22. The apparatus of claim 21 wherein the second gripping system is an adjustable gripping system comprising an inflatable bladder fixed to the second housing portion, and wherein the inflatable bladder is inflatable from a first position, that allows movement of the second tubular structure relative to the second housing portion, to a second position, that prevents movement of the second tubular structure relative to the second housing portion.

23. The apparatus of claim 21 wherein the first gripping system comprises a plurality of locking paddles collectively configured to selectively grip the tubular structure, and wherein the locking paddles are moveable between the engaged position that allows relative movement of the tubular structure and the disengaged position.

* * * * *